US005690144A

United States Patent [19]

Takahashi

[11] Patent Number: 5,690,144

[45] Date of Patent: Nov. 25, 1997

[54] DIRECTIONAL CONTROL VALVE FOR SWITCHING THE MODE OF OPERATION IN A HEAT TRANSFER SYSTEM

[75] Inventor: Ikuo Takahashi, Utsunomiya, Japan

[73] Assignee: Ranco Japan Ltd., Tokyo, Japan

[21] Appl. No.: 552,876

[22] Filed: Nov. 3, 1995

[30] Foreign Application Priority Data

Nov. 4, 1994 [JP] Japan ..... 6-271307

[51] Int. Cl.[6] ..... F16K 11/00

[52] U.S. Cl. ..... 137/625.43; 251/59

[58] Field of Search ..... 137/625.43; 251/38, 251/59, 129.11

[56] References Cited

U.S. PATENT DOCUMENTS

| | | | |
|---|---|---|---|
| 2,855,000 | 10/1958 | Van Allen et al. | 137/625.43 |
| 4,139,355 | 2/1979 | Turner et al. | 137/625.43 X |
| 4,655,252 | 4/1987 | Krumhansl | 251/59 X |
| 5,083,744 | 1/1992 | Reinicke et al. | 251/129.11 |
| 5,507,315 | 4/1996 | Parker | 137/625.43 |

*Primary Examiner*—John Fox

*Attorney, Agent, or Firm*—Michael N. Meller

[57] ABSTRACT

A directional control valve is provided for switching the mode of operation in a heat transfer system which includes a compressor, for compressing a refrigerant, with discharge and suction ports, first and second heat exchangers, and an expansion valve provided between the first and second heat exchangers. The directional control valve includes a cylindrical valve body with a high pressure port which is fluidly connected to the discharge port through a conduit, a low pressure port which is fluidly connected to the suction port through a conduit, first and second ports which are connected to the first and second heat exchangers respectively through conduits. The directional control valve further includes a first valve element which is enclosed within the valve body and is rotational between first and second rotational positions about the axis of the valve body and an arrangement for rotating the first valve element between the first and second positions. The first valve element includes passages for fluidly connecting, at the first rotational position, the high pressure port to the second port, and connecting the low pressure port to the first port, and at the second rotational position, connecting the high pressure port to the first port, and connecting the low pressure port to the second port to switch the flow direction of the refrigerant in the heat transfer system.

5 Claims, 6 Drawing Sheets

DIRECTIONAL CONTROL VALVE FOR SWITCHING THE MODE OF OPERATION IN A HEAT TRANSFER SYSTEM

BACKGROUND OF THE INVENTION (1) Field of the Invention

The invention relates to a directional control valve which is used, in a heat transporting system such as a heat pump, for switching the system between a cooling mode and a heating mode.

(2) Description of the Related Art

In a heat transporting system, a directional control valve, in particular, a 4-way valve switches the flow direction of a heating medium in the system to provide cooling and heating modes.

FIG. 10 illustrates a heat transporting system, such as a heat pump, is illustrated, in which a prior art directional control valve is used for switching the system between a cooling mode and a heating mode.

In FIG. 10, the heat transporting system comprises a compressor, for compressing a refrigerant medium, a directional control valve 9 which is fluidly connected to the compressor by conduits 18*a* and 18*b*, an indoor heat exchanger 19 which is fluidly connected to the directional control valve 9 through a conduit 9*a*, an outdoor heat exchanger 20 which is fluidly connected to the directional control valve 9 through a conduit 9*b*, and a expansion valve 21 which is connected to the indoor and outdoor heat exchanger 19 and 20.

The directional control valve 9 comprises substantially a cylindrical valve body 11 with first and second ends 11*a* and 11*b*, and a valve element 26 provided within the valve body 11. The valve element 26 is slidable longitudinally between first and second positions. The valve body 11 includes a valve seat 16 on the inner surface thereof. The valve element 26 sealingly contacts the valve seat 16. The valve body 11 further includes a high pressure inlet port 12 which is connected to a discharge port of the compressor 18 through the conduit 18*a*, a low pressure outlet port 15 which is connected to a suction port of the compressor 18 through the conduit 18*b*, and first and second ports 14 and 15 which are connected to the indoor and outdoor heat exchangers 19 and 20 through the conduits 9*a* and 9*b* respectively. The first and second ports 14 and 15 open to the valve seat 16.

A pair of pistons 23 and 24 are provided on the both sides of the valve element, slidable within the valve body 11, and connected to the valve element 26 by a rod 25 which extends longitudinally. The pair of pistons 23 and 24 include passages 23*a* and 24*a* respectively. First and second pressure chambers 23*b* and 24*b* are defined between the first end 11*a* of the valve body 11 and the first piston 23, and the second end 11*b* and the second piston 24 respectively.

The valve element 26 includes a switching passage 26*a* for fluidly connecting the low pressure outlet port 13 to one of the first and second ports 14 and 15. The first port 14 fluidly communicates with the low pressure outlet port 13 through the switching passage 26*a* when the valve element 26 is at the first position as shown in FIG. 10. At this time, the second port 15 communicates with the high pressure inlet port 12. On the other hand, when the valve element moves to the second position (to the right in FIG. 10), the second port 15 fluidly communicates with the low pressure outlet port 13 through the switching passage 26*a*. At this time, the first port 14 communicates with the high pressure inlet port 12.

The heat transporting system is further provided with a pilot valve 8. The pilot valve 8 comprises substantially a cylindrical valve body 28 with a valve seat 29 and a valve element 35. The valve body includes first, second and third ports 31*a*, 32*a* and 33*a*. The first port 31*a* of the pilot valve 8 is fluidly connected to the first pressure chamber 23*b* of the directional control valve 9 through a conduit 31. The second port 32*a* of the pilot valve 8 is connected to the low pressure outlet port 13 of the directional control valve 9 through a conduit 32. The third port 33*a* of the pilot valve 8 is connected to the second pressure chamber 24*b* of the directional control valve 9 through a conduit 33.

The valve element 35 is longitudinally slidable between first and second positions. The valve element 35 contacts the valve seat 29 to connect the first port 31*a* to the second port 32*a*, and to separate third port 33*a* from the other ports 31*a* and 32*a* when the valve element 35 is at the first position as shown in FIG. 10. On the other hand, when the valve element 35 moves to the second position (to the right in FIG. 10), the valve element contacts the valve seat 29 to connect the third port 33*a* to the second port 32*a*, and to separate the first port 31*a* from the other ports 32*a* and 33*a*.

The pilot valve 8 is further provided with a solenoid 8*a* which includes a movable core 36 which is slidable in the longitudinal direction, a stationary core 37 which is secured to the end of the solenoid 8*a*, a coil 39 provided around the cores 36 and 37, and a spring 38 which is provided between the movable and stationary cores 36 and 37. The spring 38 biases the movable core 36 to the left in FIG. 10.

The movable core 36 and the valve element 35, which is connected to the movable core 36, moves to the left by the biasing force of the spring 38 when the coil 39 is deenergized. This fluidly connects the second port 32*a* to the first port 31*a*, and separates the third port 33*a* from the second and first ports 32*a* and 31*a*. Thus, the lower pressure within the low pressure outlet port 13 is applied to the first pressure chamber 23*b* through the second conduit 32 and the first conduit 31. The higher pressure within the high pressure inlet port 12 is applied to the second pressure chamber 24*b* through the passage 24*a*. Therefore, the first and second pistons 23 and 24, the rod 25 and the valve element 26 move to the left as shown in FIG. 10, which connects the first port 14 to the low pressure outlet port 13 of the directional control valve 9.

The pressurized refrigerant from the compressor 18 flows to the outdoor heat exchanger 20 via the conduit 18*a*, the high pressure inlet port 12, the valve body 11, the second port 15 and the conduit 9*b*. The temperature of the refrigerant is reduced by the outdoor heat exchanger 20. The cooled refrigerant is expanded through the expansion valve 21. During the expanding process, the temperature of the refrigerant is further reduced. The expanded refrigerant is supplied to the indoor heat exchanger 19 in which heat is transferred, to the refrigerant from the air in a room where the indoor heat exchanger 19 is installed, to cool the air in the room. The heated refrigerant returns to the compressor via conduit 9*a*, the first port 14, the switching passage 26*a*, the low pressure outlet port 13 and the conduit 18*b*. Thus, the cooling mode of operation is provided.

The movable core 36 and the valve element 35, which is connected to the movable core 36, moves to the right against the biasing force of the spring 38 when the coil 39 is energized. This fluidly connects the second port 32*a* to the third port 33*a*, and separates the first port 31*a* from the second and third ports 32*a* and 33*a*. Thus, the lower pressure within the low pressure outlet port 13 is applied to the second pressure chamber 24b through the second conduit 32 and the third conduit 33. The higher pressure within the high pressure inlet port 12 is applied to the first pressure chamber 23b through the passage 23a. Therefore, the first and second pistons 23 and 24, the rod 25 and the valve element 26 move to the right, which connects the second port 15 to the low pressure outlet port 13 of the directional control valve 9.

The pressurized refrigerant from the compressor 18 flows to the indoor heat exchanger 19 via the conduit 18a, the high pressure inlet port 12, the valve body 11, the first port 14 and the conduit 9a. The temperature of the refrigerant is reduced by the indoor heat exchanger 20 to heat the air in the room. The cooled refrigerant is expanded through the expansion valve 21. The expanded refrigerant is supplied to the outdoor heat exchanger 20 in which heat is transferred to the refrigerant from the open air. The heated refrigerant returns to the compressor via conduit 9b, the second port 15, the switching passage 26a, the low pressure outlet port 13 and the conduit 18b. Thus, the heating mode of operation is provided.

In the prior art heat transfer system shown in FIG. 10, the pilot valve 8 and the conduits 31, 32 and 33 must be provided to control the directional control valve 9. This makes the system large and complex. Further, the solenoid 8a of the pilot valve 8 must be energized during the heating mode, which increases the energy consumption.

Further, the directional control valve 9 has the high pressure inlet port 12 and low pressure outlet port 13 which are provided an either side of the valve body 11. This makes the piping work complex at the installation since piping connected to one of the inlet and outlet ports, in particular the piping connected to the outlet port, must be bent into a U shape.

Further, the prior art directional control valve 9 has the elongated cylindrical valve body 11 which require a relatively large space to dispose the directional control valve in the indoor unit housing.

Further, in the prior art directional control valve 9, the first and second ports 14 and 15 communicate with each other during the transition of the mode of operation to prevent the pressure at the discharge of the compressor 18 from getting too high. Thus, the high pressure port 12, low pressure port 13, and first and second ports can communicate with each other when the valve element 26 slides when the mode of operation is switched between the cooling and heating modes. If the flow rate of the refrigerant is relatively small, the valve element 26 cannot move since the pressure deference between the first and second pressure chambers 23b and 24b disappears. This prevents the heat transfer system from switching the mode of operation.

SUMMARY OF THE INVENTION

The invention is directed to solve the above-mentioned problems in the prior art.

According to the invention, there is provided a directional control valve for switching the mode of operation in a heat transfer system which includes a compressor for compressing a refrigerant with discharge and suction ports, first and second heat exchangers, and an expansion valve provided between the first and second heat exchangers. The directional control valve comprises a cylindrical valve body with a high pressure port which is fluidly connected to the discharge port through a conduit, a low pressure port which is fluidly connected to the suction port through a conduit, first and second ports which are connected to the first and second heat exchangers respectively through conduits. The directional control valve further comprises a first valve element which is enclosed within the valve body, and rotational between first and second rotational positions about the axis of the valve body; and means for rotating the first valve element between the first and second positions. The first valve element includes means for fluidly connecting, at the first rotational position, the high pressure port to the second port, and connecting the low pressure port to the first port, and at the second rotational position, connecting the high pressure port to the first port, and connecting the low pressure port to the second port to switch the flow direction of the refrigerant in the heat transfer system.

The directional control valve according to the invention no longer needs a pilot valve to drive the valve element. Further, in the inventive directional control valve, the valve element can rotate within the valve body while, in the prior art, the valve element slides within the valve body. Thus, the inventive directional control valve no longer needs an elongated valve body, which reduces the space in which the directional control valve is disposed.

The rotating means preferably comprises first and second pressure chambers which are integrally formed with the first valve element; means for fluidly connecting the first and second pressure chambers to the high pressure port; and means for selectively fluidly connecting one of the first and second chambers to the low pressure port. The first valve element rotates from a first rotational position to a second rotational position when the second pressure chamber is fluidly connected to the low pressure port due to the pressure difference between the first and second pressure chambers, and rotates from second rotational position to the first rotational position when the first pressure chamber is connected to the low pressure port due to the pressure difference between the first and second pressure chambers.

The directional control valve may further comprise means for separating the first and second passage from the first and second pressure chambers when the valve element rotates to the first and second rotational positions respectively.

The selectively fluidly connecting means preferably comprises a second valve element which is rotatable between first and second rotational positions; a rotor axially aligned to the valve element, the rotor being rotatable between first and second positions about the axis of the valve body to rotate the second valve element between the first and second rotational positions; and a driver for rotating the rotor between first and second rotational positions. The second valve element includes a passage for connecting the low pressure passage to the second passage at the first rotational position of the second valve member, and for connecting the low pressure passage to the first passage at the second rotational position of the second valve member.

The driver preferably comprises permanent magnets disposed around the rotor to alternate the radially poles of the permanent magnets, and electromagnets radially outwardly disposed around the permanent magnets.

The directional control valve may further comprise a pin axially extending from the rotor to the first valve element; and a slot, extending on the valve element along an arc about the rotational axis of the valve element, for receiving the pin. The engaging between the pin and the slot prevents the first valve element stopping when the pressure difference between the first and second pressure chambers disappears during the switching the mode of operation.

BRIEF DESCRIPTION OF THE DRAWINGS

These and other objects and advantages, and further descriptions will now be discussed in connection with the drawings in which.

DESCRIPTION OF THE PREFERRED EMBODIMENTS

Figure 1:
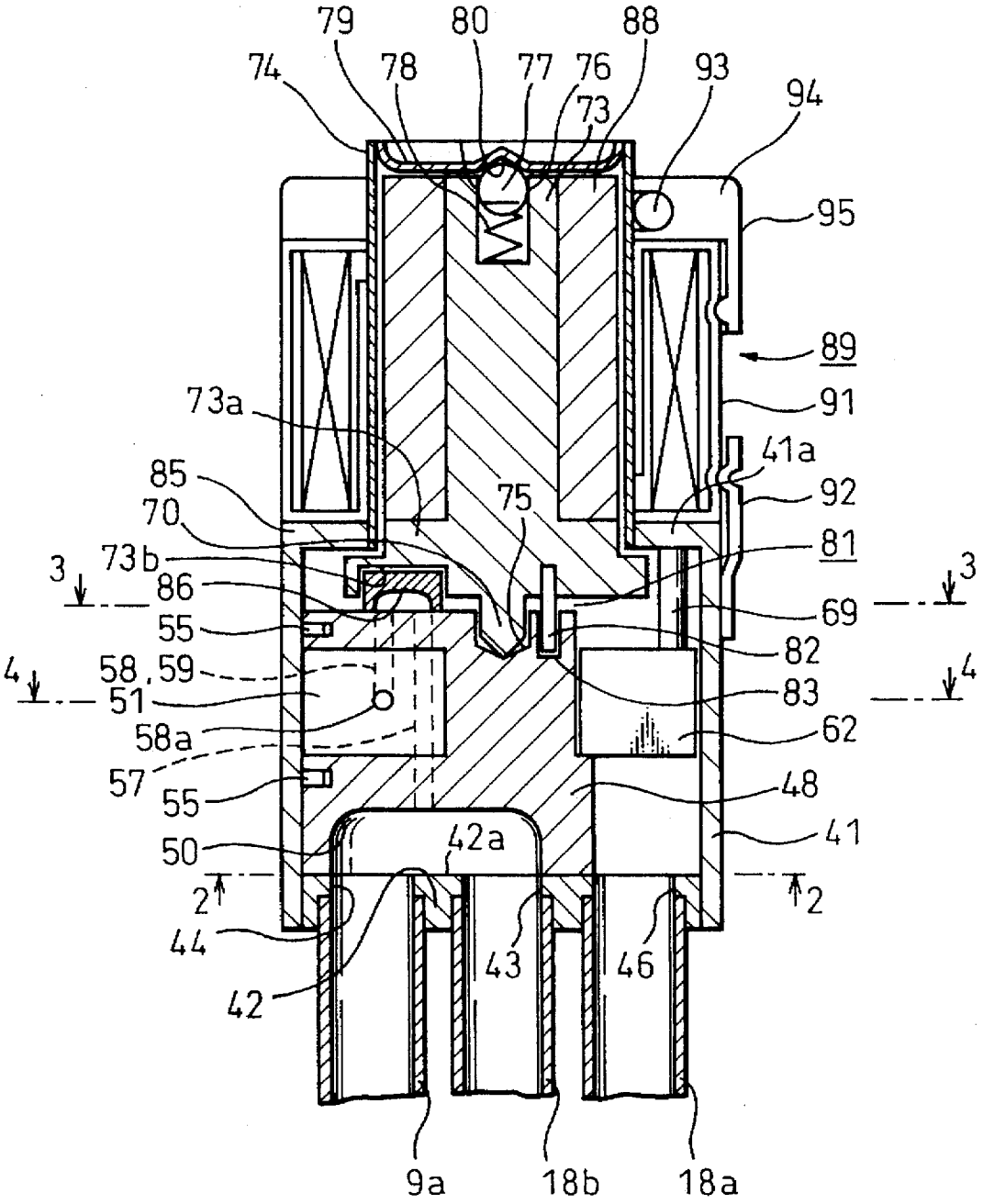
FIG. 1 is a section of a directional control valve according to the invention.

With reference to FIGS. 1 to 9, the preferred embodiment of the invention will be described. In the drawings and the description, the elements similar to the prior art described above and shown in FIG. 10 are indicated by the same reference numbers.

Figure 2:
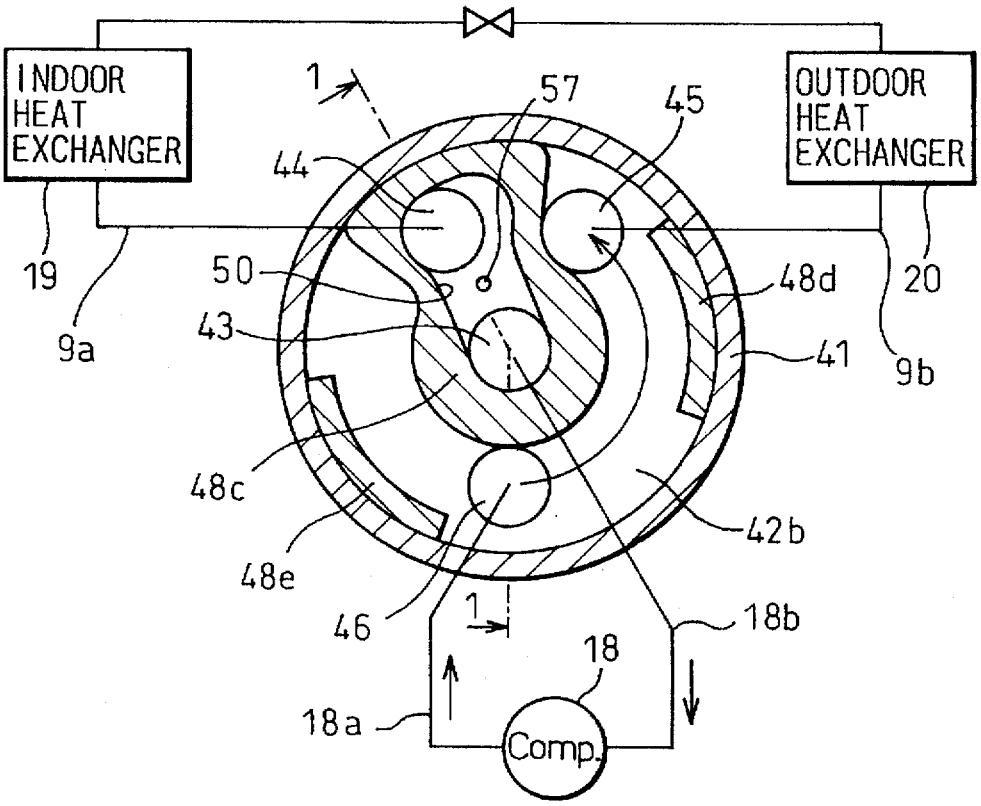
FIG. 2 is a section of the directional control valve of FIG. 1 along line 2—2, and illustrates with a schematic drawing, a heat transfer system to which the invention is applied.

In FIGS. 1 and 2, a directional control valve 10 according to the invention is illustrated. The directional control valve 10 comprises substantially a cylindrical valve body 41, end plate 42, and a valve element 48 which is provided within the valve body 41 for rotation about the axis of the directional control valve 10. The inner surface of the end plate 42 defines a valve seat surface 42*a* to which the valve element 48 sealingly slidably contacts.

The end plate 42 includes a high pressure inlet port 46, low pressure outlet port 43, and first and second ports 44 and 45 (FIG. 2). The first and second ports 14 and 15 open to the valve seat surface 42*a*. The high pressure inlet port 46 is fluidly connected to the discharge port of the compressor 18 via the conduit 18*a*. The low pressure outlet port 43 is fluidly connected to the inlet port of the compressor 18 via the conduit 18*b*. The first and second ports 44 and 45 are connected to the indoor and outdoor heat exchangers 19 and 20, through the conduits 9*a* and 9*b* respectively, as in the prior art described above.

Figure 6:
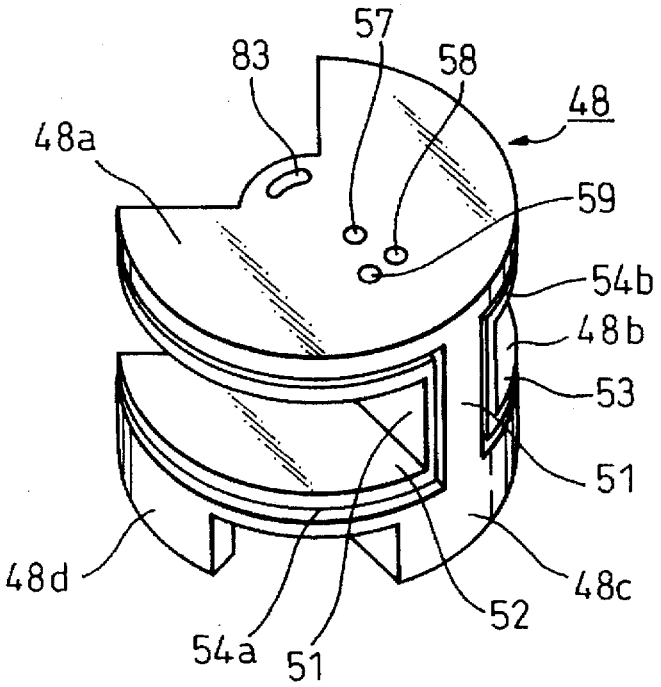
FIG. 6 is a perspective illustration of a valve element according to the invention.

With reference to FIG. 6, the valve element 48 is substantially a cylindrical member which includes a top plate 48*a* in the form of a sector, and a bottom plate 48*b*. The bottom plate 48*b* is formed into substantially the same configuration as the top plate 48*a*. The top and bottom plates 48*a* and 48*b* are axially spaced and aligned to each other as shown in FIG. 6. Between the top and bottom plates 48*a* and 48*b*, a partition wall 51 is provided. The partition wall 51 is integrally formed with the top and bottom plates 48*a* and 48*b* to connect the plates. When the valve element 48 is positioned within the cylindrical valve body 41, the top and bottom plates 48*a* and 48*b*, the partition wall 51 and the valve valve body 41 define first and second second recessed portions 52 and 53.

With reference to FIGS. 2 and 6, the bottom plate 48*b* includes at the bottom thereof an island 48*c* and first and second arc legs 48*d* and 48*e*. The island 48*b* includes a recess 50 in the bottom surface for selectively connecting the low pressure outlet port 43 to one of the first and second ports 44 and 45 according to the rotational position of the valve element 48. The valve seat surface 42*a*, the island 48*c*, and the valve body 41 define a passage 42*b* for selectively connecting the high pressure port 46 to one of the second and first ports 45 and 44 according to the rotational position of the valve element 48.

The valve element 48 further includes a pair of grooves 54*a* and 54*b* which extend along the outer surface valve element 48 as shown in FIG. 6. Seal members 55 (FIG. 5) are fitted into the respective grooves 54*a* and 54*b* for sealing the first and second recessed portions 52 and 53. The seal members 55 are biased, when assembled, against the inner surface of the valve body 41 by its resilience to ensure a sufficient sealing effect for the first and second recessed portions 52 and 53.

Figure 7:
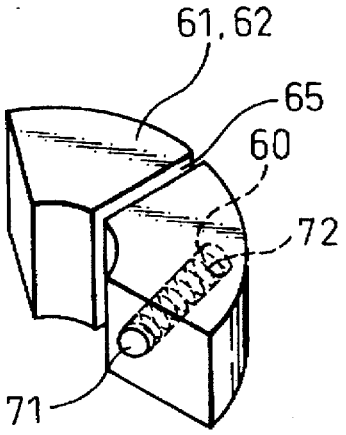
FIG. 7 is a perspective illustration of a block for defining a pressure chamber according to the invention.
Figure 8:
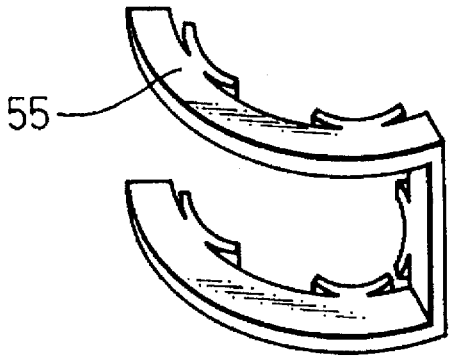
FIG. 8 is a perspective illustration of a seal member for sealing the pressure chamber according to the invention.

Within the first and second recessed portions 52 and 53, blocks 61 and 62 are provided. The blocks 61 and 62 are formed into substantially a cylindrical sector member as shown in FIG. 7. The blocks 61 and 62 include a groove 55 which extends axially and radially along the surface of the members 61 and 62. In the grooves 65, sealing members 66*a* and 66*b* are provided. The sealing members 66*a* and 66*b* are sealingly engaged to each other at the ends thereof which are made complementary to each other.

Figure 9:
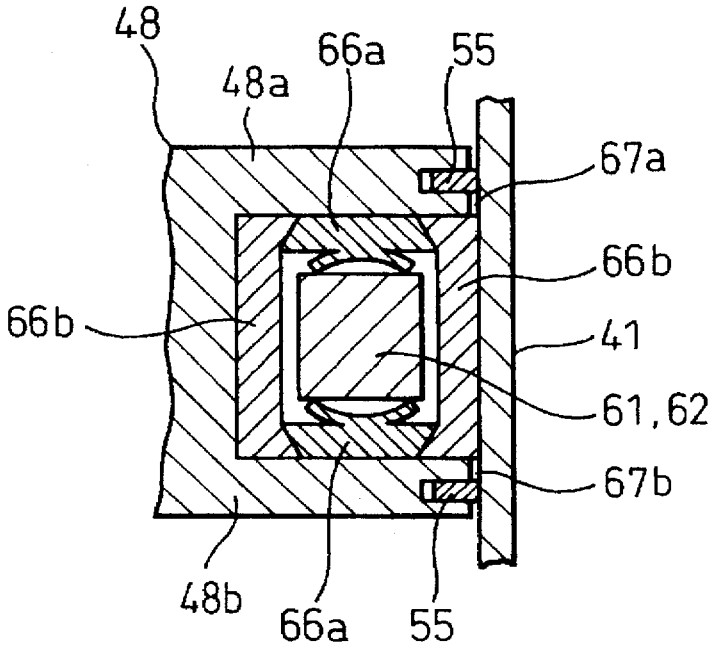
FIG. 9 is a partial section of an assembly of the block and the seal member within the directional control valve.
Figure 10:
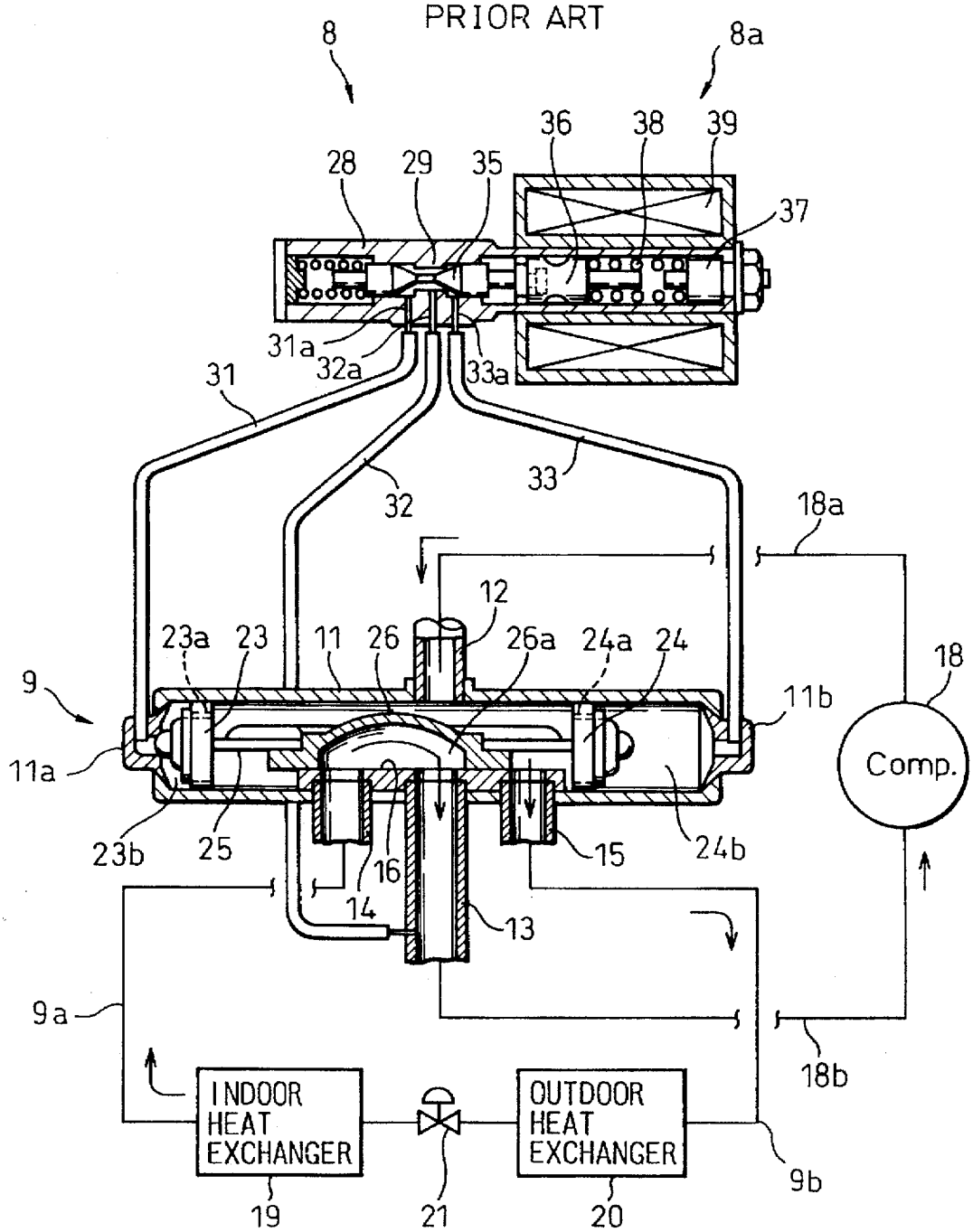
Fig. 10 PRIOR ART
FIG. 10 is a section of a directional control valve and a pilot valve, and illustrated with a schematic drawing of a heat transfer system according to the prior art.

The sealing members 66*a* and 66*b* sealingly contact the inner surfaces of the first and second recessed portions 52 and 53, and the inner surface of the valve body 41. The valve body 41, the top plate 48*a*, the bottom plate 48*b*, the partition wall 51, the sealing members 66*a* and 66*b*, and the blocks 61 and 62 within the respective recessed portions 52 and 53 define first and second pressure chambers 63 and 64. The first and second pressure chambers 63 and 64 communicate with high pressure inlet port 46 through clearances 67*a* and 67*b* between the top and bottom plates 48*a* and 48*b*, and the valve body 41 as shown in FIG. 9.

Figure 4:
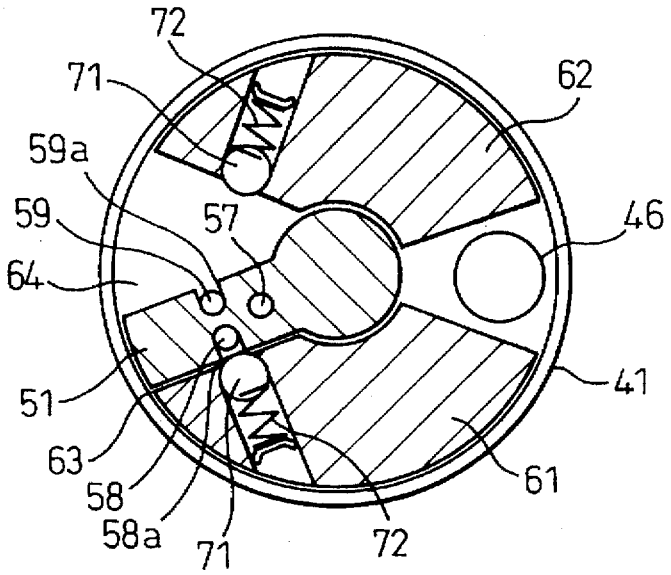
FIG. 4 is a section of the directional control valve of FIG. 1 along line 4—4.

The valve element 48 further includes a low pressure passage 57, and first and second passages 58 and 59. The low pressure passage 57 axially extends through the top plate 48*a*, the partition wall 51 and the bottom plate 48*b* to communicate with the recess 50 of the bottom plate 48*b*. The first passage 58 axially extends through the top plate 48*a*. The first passage 58 further extends in the partition wall 51 to an axially intermediate position, and then bends in a direction perpendicular to the axis to communicate with the first pressure chamber 63. In FIGS. 1 and 4, an opening 58*a* of the first passage 58 in one of the side surfaces of the partition wall 51 is shown. The second passage 59 axially extends through the top plate 48*a*. The second passage 59 further extends in the partition wall 51 to an axially intermediate position, and then bends in the opposite direction to the first passage 58 to communicate with the second pressure chamber 64. In FIG. 4, an opening 59*a* of the second passage 59 in the other side surface of the partition wall 51 is shown. The first and second passages 58 and 59 are disposed along a circle in the top plate 48*a* about the low pressure passage 57 as shown in FIG. 6.

The blocks 61 and 62 are mounted to the valve body 41 by pins 69 so that the blocks 61 and 62 do not rotate relative to the valve body 41. The pins 69 axially extend from a top wall 41*a* of the valve body 41 and are secured thereto. Thus, the blocks 61 and 62 do not rotate when the valve element 48 rotates. The blocks 61 62 limit the rotational angle of the valve element 48 by abutting the partition wall 51.

The blocks 61 and 62 further include, as shown in FIG. 7, blind holes 60, plug members, balls 71 which are held in the blind holes 60 and coil springs 72 for outwardly biasing the balls 71. The blind holes 60 and the balls 71 are disposed so that the balls 71 can plug the respective openings, on the partition wall 51, of the first and second passages 58 and 59 when the blocks 61 and 62 abut the either side surfaces of the partition wall 51.

Referring again to FIG. 1, the directional control valve 10 further comprises a substantially cylindrical rotor 73 which is provided on the valve element 48. The rotor 73 is rotational about the rotational axis of the valve element 48 separately from the valve element 48. The rotor 73 is enclosed by a cylindrical casing 74 and an end plate 79 of a non-magnetic material. The rotor 73 includes a bottom plate 73*a* substantially in the form of a disc, a post 70 as a rotational shaft of the rotor 73, at the bottom of the rotor 73, with a cone end, and a blind hole 76 at the top of the rotor 73. The post 70 is fitted into a blind hole 75 at the top of the valve element 48. The post 70 has a length sufficient to make a clearance between the top of the valve element 48 and the bottom of the rotor 73. Within the blind hole 76 of the rotor 73, a ball 77 and coil spring 78 for outwardly biasing the ball 76 are provided. The ball 76 engages a dent 80 provided at the center of the end plate 79.

The directional control valve 10 is further provided with an interlocking mechanism 81, between the rotor 73 and the valve element 48, for rotating the valve element 48 when the rotor 73 rotates beyond a predetermined angle. The interlocking mechanism 81 includes a pin 82 which is secured to the bottom surface of the rotor 73, and a slot which is provided on the top surface of the valve element 48 (FIG. 6). The pin 82 is movable within the slot 83. Contacting the pin 82 to one of the ends of the slot 83 connects the rotor 73 and the valve element 48 when the rotor 73 rotates. This allows the valve element 48 to rotate with the rotor 73.

The directional control valve 10 is further provided with an sub-valve element 85 between the top surface of the valve element 48 and the rotor 73. In particular, the sub-valve element 85 is provided within a recess 73*b* provided on the bottom surface of the bottom plate 73*a* of the rotor 73. The sub-valve element 85 includes a recess 86 for selectively fluidly connecting the low pressure passage 57 to one of the first and second passage depending on the rotational position of the sub-valve element 85 relative to the valve element 48.

Figure 5:
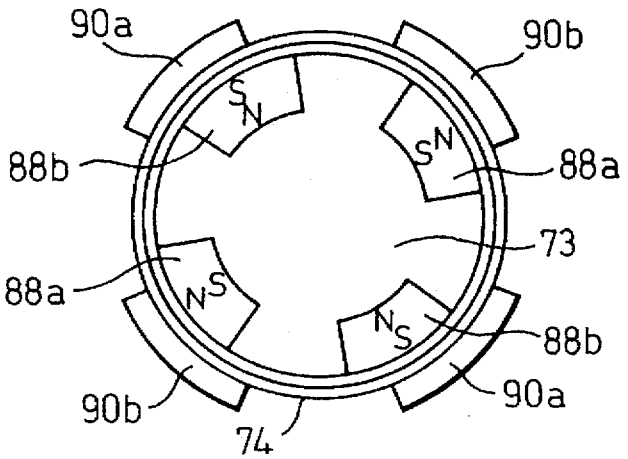
FIG. 5 illustrates the disposition of permanent magnets and stator cores for driving a rotor according to the invention.

The directional control valve 10 is further provided with a permanent magnet assembly 80 around the rotor 73. The permanent magnet assembly 80 is integrally connected to the rotor 73. The permanent magnet assembly 80 comprises a plurality of permanent magnets 88*a* and 88*b* (FIG. 5) which are disposed at an interval around the rotor 73 so that the radially outer magnetic poles of the respective permanent magnet 88*a* and 88*b* alternate. In FIG. 5, the permanent magnets, of which the radially outer magnetic poles are N, are indicated by 88*a*, and the permanent magnets, of which the radially outer magnetic poles are S, are indicated by 88*b*. Permanent magnets more than four can be provided.

A driver 89 for rotationally driving the rotor 73 is provided around the casing 74. The driver 89 comprises a plurality of stator cores 90*a* and 90*b* (FIG. 5) and a coil 91. The stator cores 90*a* and 90*b* are disposed around the casing 74 at an interval. The coil 91 is provided so that the poles of the respective stator cores 90*a* and 90*b* are alternate. A power source (not shown) for energizing the coil 91 is provided. The power source can supply the electric power to the coil so as to rotate the rotor in both directions. The coil 91 is secured to the valve body 41 by engagement between a snap spring 92, which is secured to the valve body 41, and a dent on the coil 91.

The directional control valve 10 is further provided with a sensor 93 such as a lead switch for magnetically detecting the rotational position of the rotor 73 through interaction with the permanent magnets 88*a* and 88*b*. The sensor 93 is held by a holding member 94 in the form of a ring. The holding member 94 has a snap spring 95 which is integrally formed with the holding member 94. The holding member 94 is secured to the coil 91 by engaging the snap spring 95 to a dent on the coil 91.

The functional operation of the directional control valve 10 will be described.

When the heat transferring system of FIG. 2 operates in its cooling mode, the high pressure port 44 is connected to the second port 45 through the passage 42*b*, and the low pressure outlet port 43 is connected to the first port 44 through the recess 50 of the valve element 48. Thus, the compressed refrigerant from the compressor 18 is supplied to the outdoor heat exchanger 20 through the conduit 18*a*, high pressure port 46, passage 42*b*, the second port 45, and the conduit 9*b*. The refrigerant from the outdoor heat exchanger 20 is expanded by the expansion valve 21, and supplied to the indoor heat exchanger 19. At the indoor heat exchanger, the expanded refrigerant reduces the temperature of the air in a room where the indoor heat exchanger 19 is installed. Then, the refrigerant returns to the compressor 18 through the conduit 9*a*, the first port 44, the recess 50, the low pressure port 43, and the conduit 18*b*.

Figure 3:
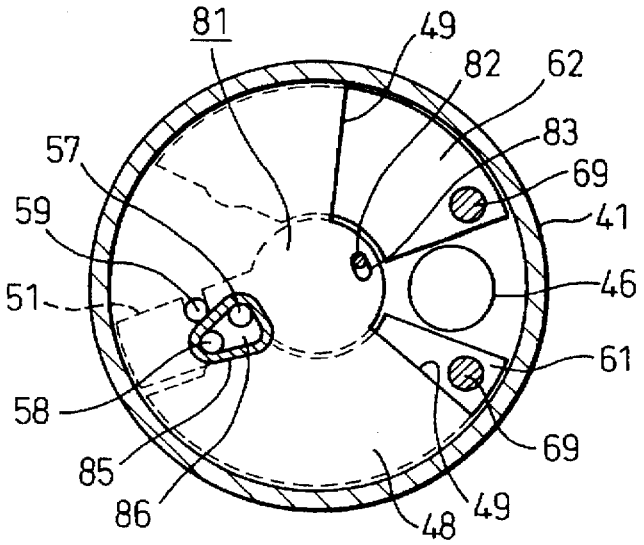
FIG. 3 is a section of the directional control valve of FIG. 1 along line 3—3.

During the cooling mode of operation, the low pressure passage 57 in the valve element 48 is connected to the first passage 58 through the recess 86 of the sub-valve element 85 as shown in FIGS. 1 and 3, while the second passage 59 communicates with the high pressure port 46 through the clearance between the valve element 48 and the rotor 73. At this time, the opening 58*a* of the first conduit 58, which opening 58*a* is provided in one side of the partition wall 51, is blocked by the ball 71 as shown in FIG. 4.

In order to change the operational mode from cooling to heating, the coil 91 is energized to rotate the rotor 73 in the clockwise direction in FIG. 2. The rotor rotates in the clockwise direction separately from the valve element until the pin 82 contacts one end of the slot 83 while the valve element 48 does not rotates.

The rotation of the rotor 73 rotates the sub-valve element 85 which is held within the recessed portion 73*b* of the rotor 73. This separates the low pressure passage 57 from the first passage 58, and connects to the second passage 59 through the recess 86. The first passage communicates with the high pressure port 46 through the clearance between the top of the valve element 48 and the bottom of the rotor 73. Thus, the pressure within the first pressure chamber 63 is increased since a pressure at the high pressure port 46 is applied to the first pressure chamber 63 through the first passage 58 while the pressure within the second pressure chamber 64 is reduced since the second passage 59 communicates with the low pressure passage 57 through the recess 86. The pressure deference between the first and second pressure chambers 63 and 64 rotates the valve element 48 with the rotor 73 in the clockwise direction in FIGS. 2 and 4.

Abutment between the partition wall 51 and the block 62 stops the rotation of the valve element 48. When the partition wall 51 abuts the block 62, the ball 71 of the block 62 plugs the opening 59*a* of the second passage 59 to separate the second pressure chamber 64 from the low pressure passage 57. Thus, the pressure within the second pressure chamber 64 is increased since the second pressure chamber 64 communicates with the high pressure port 46 through the clearances 67*a* and 67*b* between the valve element 48 and the valve body 41. The pressure within the first pressure chamber 63 balances that in the second pressure chamber 64, and the rotational position of the valve element 48 is maintained.

The rotation in the clockwise direction of the valve element 48 separates the high pressure port 46 from the second port 45, and connects it to the first port 44. The second port 45 is connected to the low pressure port 43. This results in the switching of the flow direction of the refrigerant. Thus, the mode of operation is changed from the cooling mode to the heating mode.

The rotation of the rotor 73 in the counter-clockwise direction in FIGS. 2 and 4 changes the mode of operation from the heating mode to the cooling mode.

The coil 91 is deenergized when the sensor 93 detects that the rotor 73 has rotated to a rotational position where one of the side surfaces of the partition 51 abuts the one of the blocks 61 and 62.

As mentioned above, the rotor 73 rotates with the valve element 48 when the pin 82 contacts one of the ends of the slot 83. Therefore if the pressure deference between the first and second pressure chambers disappears as in the prior art, the valve element 48 can still rotate to switch the mode of operation.

As mentioned above, the valve element 48 is maintained at the rotational position after the partition wall abuts one of the blocks 61 and 62 since the pressures within the first and second pressure chambers 63 and 64 balance each other. This allows the coil to be deenergized to save energy consumption.

It is further understood by those skilled in the art that the forgoing description is a preferred embodiment of the disclosed device and that various changes and modifications may be made without departing from the spirit and scope of the invention.

I claim:

1. A directional control valve for switching the mode of operation in a heat transfer system which includes a compressor, for compressing a refrigerant with discharge and suction ports, first and second heat exchangers, and an expansion valve provided between the first and second heat exchangers, comprising:

a cylindrical valve body with a high pressure port which is fluidly connected to the discharge port through a conduit, a low pressure port which is fluidly connected to the suction port though a conduit, first and second ports which are connected to the first and second heat exchangers respectively through conduits;

a first valve element which is enclosed within the valve body, and rotational between first and second rotational positions about the axis of the valve body;

means for rotating the first valve element between the first and second positions;

the first valve element including means for fluidly connecting, at the first rotational position, the high pressure port to the second port, and connecting the low pressure port to the first port, and at the second rotational position, connecting the high pressure port to the first port, and connecting the low pressure port to the second port to switch the flow direction of the refrigerant first and second pressure chambers which are integrally formed with the first valve element;

means for fluidly connecting the first and second pressure chambers to the high pressure port;

means for selectively fluidly connecting one of the first and second chambers to the low pressure port; and the first valve element rotating from first rotational position to the second rotational position when the second pressure chamber is fluidly connected to the low pressure port due to the pressure difference between the first and second pressure chambers, and rotating from second rotational position to the first rotational position when the first pressure chamber is connected to the low pressure port due to the pressure difference between the first and second pressure chambers.

2. A directional control valve according to claim 1 further comprising means for separating the first and second passage from the first and second pressure chambers when the valve element rotates to the first and second rotational positions respectively.

3. A directional control valve according to claim 2 in which the means for selectively fluidly connecting means comprises:

a second valve element which is rotatable between first and second rotational positions;

a rotor axially aligned to the valve element, the rotor being rotatable between first and second positions about the axis of the valve body to rotate the second valve element between the first and second rotational positions;

a driver for rotating the rotor between first and second rotational positions; and the second valve element including a passage for connecting the low pressure passage to the second passage at the first rotational position of the second valve member, and for connecting the low pressure passage to the first passage at the second rotational position of the second valve member.

4. A directional control valve according to claim 3 in which the driver comprises:

permanent magnets disposed around the rotor with the poles on the surface of the rotor arranged in an alternating manner; and electromagnets radially outwardly disposed around the permanent magnets.

5. A directional control valve according to claim 4 further comprises:

a pin axially extending from the rotor to the first valve element; and a slot, extending on the valve element along an arc about the rotational axis of the valve element, for receiving the pin.

* * * * *